US009859635B1

(12) United States Patent
Pickel et al.

(10) Patent No.: US 9,859,635 B1
(45) Date of Patent: Jan. 2, 2018

(54) ELECTRICAL CONNECTOR HAVING LOSSY BLOCKS

(71) Applicants: TYCO ELECTRONICS CORPORATION, Berwyn, PA (US); TE Connectivity Nederland B.V., s'-Hertogenbosch (NL); Tyco Electronics Belgium EC BVBA, Oostkamp (BE)

(72) Inventors: Justin Dennis Pickel, Hummelstown, PA (US); Timothy Robert Minnick, Enola, PA (US); Chad William Morgan, Carneys Point, NJ (US); Rutger Wilhelmus Smink, Achel (BE); Lieven Decrock, Roeselare (BE); Margaret Mahoney Fernandes, West Chester, PA (US)

(73) Assignees: TE CONNECTIVITY CORPORATION, Berwyn, PA (US); TE CONNECTIVITY NEDERLAND B.V., S'Hertogenbosch (NL); TYCO ELECTRONICS BELGIUM EC BVBA, Oostkamp (BE)

( * ) Notice: Subject to any disclaimer, the term of this patent is extended or adjusted under 35 U.S.C. 154(b) by 0 days.

(21) Appl. No.: 15/262,115

(22) Filed: Sep. 12, 2016

(51) Int. Cl.
*H01R 12/00* (2006.01)
*H01R 12/71* (2011.01)
(Continued)

(52) U.S. Cl.
CPC ..... *H01R 12/716* (2013.01); *H01R 13/04* (2013.01); *H01R 13/405* (2013.01); *H01R 13/518* (2013.01)

(58) Field of Classification Search
CPC .. H01R 12/716; H01R 12/724; H01R 12/737; H01R 13/514; H01R 12/523; H01R 23/68; H01R 23/688; H01R 13/6658; H01R 13/6585; H01R 13/6471; H01R 13/65807; H01R 12/727
See application file for complete search history.

(56) References Cited

U.S. PATENT DOCUMENTS 7,371,117 B2 5/2008 Gailus
8,083,553 B2 12/2011 Manter et al.
(Continued)

OTHER PUBLICATIONS

L. Zhang et al., "Energy-efficient Operation of Heavy Haul Trains in an MPC Framework", IEEE, 2013, 6 pages.

*Primary Examiner* — Xuong Chung Trans

(57) ABSTRACT

An electrical connector includes a housing and plural contact modules stacked adjacent to each other and held by the housing. Each contact module includes a contact array, a dielectric holder, and lossy blocks. The contact array includes signal contacts and ground contacts arranged in alternating pairs along a length of a column. The dielectric holder surrounds and engages the signal and ground contacts along intermediate segments thereof to secure the signal and ground contacts in place. The lossy blocks are mounted to the intermediate segments of the ground contacts within the dielectric holder. Each lossy block is associated with a corresponding pair of ground contacts and engages at least one of the ground contacts in the pair. The lossy blocks are composed of a lossy material that has a greater loss tangent than a low loss material that forms the dielectric holder.

20 Claims, 4 Drawing Sheets

(51) Int. Cl.

| | |
|---|---|
| ***H01R 13/405*** | (2006.01) |
| ***H01R 13/04*** | (2006.01) |
| ***H01R 13/518*** | (2006.01) |

(56) References Cited

U.S. PATENT DOCUMENTS

| | | | | |
|---|---|---|---|---|
| 8,177,564 | B1 | 5/2012 | Ito et al. | |
| 8,371,876 | B2 * | 2/2013 | Davis | H01R 12/724 439/108 |
| 8,382,524 | B2 * | 2/2013 | Khilchenko | H01R 12/724 439/620.09 |
| 8,485,831 | B2 | 7/2013 | Cipolla et al. | |
| 8,523,583 | B2 | 9/2013 | Ito | |
| 8,715,003 | B2 * | 5/2014 | Buck | H01R 12/73 439/607.07 |
| 8,771,016 | B2 * | 7/2014 | Atkinson | H01R 13/6474 439/607.07 |
| 9,028,281 | B2 | 5/2015 | Kirk et al. | |
| 9,219,335 | B2 | 12/2015 | Atkinson et al. | |
| 9,531,133 | B1 * | 12/2016 | Horning | H01R 13/6477 |
| 2014/0127946 | A1 | 5/2014 | Ito et al. | |
| 2015/0056856 | A1 | 2/2015 | Atkinson et al. | |

* cited by examiner

ELECTRICAL CONNECTOR HAVING LOSSY BLOCKS

BACKGROUND OF THE INVENTION

The subject matter herein relates generally to electrical connectors that have an array of signal and ground contacts.

Some electrical connector systems utilize electrical connectors, such as mezzanine connectors, to interconnect two circuit boards, such as a motherboard and daughter card. The conductors of one electrical connector are terminated to one circuit board and extend through the housing towards a mating end to engage mating conductors of the mating connector terminated to the other circuit board.

Some known electrical connectors have electrical problems, particularly when transmitting at high data rates. For example, the electrical connectors typically utilize differential pair signal conductors to transfer high speed signals. Ground conductors improve signal integrity. However, electrical performance of known electrical connectors, when transmitting electrical signals at high data rates, is inhibited by resonance spikes at certain frequencies.

A need remains for a high density, high speed electrical connector having reliable performance.

BRIEF DESCRIPTION OF THE INVENTION

In an embodiment, an electrical connector is provided that includes a housing and plural contact modules stacked adjacent to each other along a stack axis and held by the housing. Each contact module includes a contact array, a dielectric holder, and lossy blocks. The contact array includes signal contacts and ground contacts arranged in a column. The signal contacts and the ground contacts are arranged in alternating pairs along a length of the column such that a pair of ground contacts extends between two pairs of signal contacts. The signal and ground contacts extend between respective mating ends configured to engage a mating connector and terminating ends configured to engage a circuit board. The dielectric holder surrounds and engages the signal and ground contacts along intermediate segments of the signal and ground contacts between the mating and terminating ends to secure the signal and ground contacts in place relative to the dielectric holder. The dielectric holder is composed of a low loss material. The lossy blocks are mounted to the intermediate segments of the ground contacts within the dielectric holder. Each lossy block is associated with a corresponding pair of ground contacts and engages at least one of the ground contacts in the corresponding pair. The lossy blocks are composed of a lossy material that that has a loss tangent greater than a lost tangent of the low loss material of the dielectric holder.

In another embodiment, an electrical connector is provided that includes a housing and plural contact modules stacked adjacent to each other along a stack axis and held by the housing. Each contact module includes a contact array, a dielectric holder, and lossy blocks. The contact array includes signal contacts and ground contacts arranged in a column. The signal contacts and the ground contacts are arranged in alternating pairs along a length of the column such that a pair of ground contacts extends between two pairs of signal contacts. The signal and ground contacts extend between respective mating ends configured to engage a mating connector and terminating ends configured to engage a circuit board. The dielectric holder surrounds and engages the signal and ground contacts along intermediate segments of the signal and ground contacts between the mating and terminating ends to secure the signal and ground contacts in place relative to the dielectric holder. The dielectric holder is composed of a low loss material. The lossy blocks are overmolded over the intermediate segments of the ground contacts within the dielectric holder. Each lossy block is associated with a corresponding pair of ground contacts and overmolded over at least one of the ground contacts in the corresponding pair. The lossy blocks are composed of a lossy material that has a loss tangent greater than a lost tangent of the low loss material of the dielectric holder.

In a further embodiment, an electrical connector is provided that includes a housing and plural contact modules stacked adjacent to each other along a stack axis and held by the housing. Each contact module includes a contact array, a dielectric holder, and lossy blocks. The contact array includes signal contacts and ground contacts arranged in a column. The signal and ground contacts extend between respective mating ends configured to engage a mating connector and terminating ends configured to engage a circuit board. The lossy blocks are mounted to the ground contacts. Each lossy block engages a different corresponding ground contact. The lossy blocks are composed of a lossy material. The dielectric holder is overmolded over the contact array and the lossy blocks to secure the signal contacts, the ground contacts, and the lossy blocks in place relative to the dielectric holder. The mating ends and the terminating ends of the signal contacts and the ground contacts protrude outward from respective front and rear ends of the dielectric holder. The dielectric holder is composed of a low loss material that has a loss tangent lower than a lost tangent of the lossy material of the lossy blocks.

DETAILED DESCRIPTION OF THE INVENTION

Figure 1:
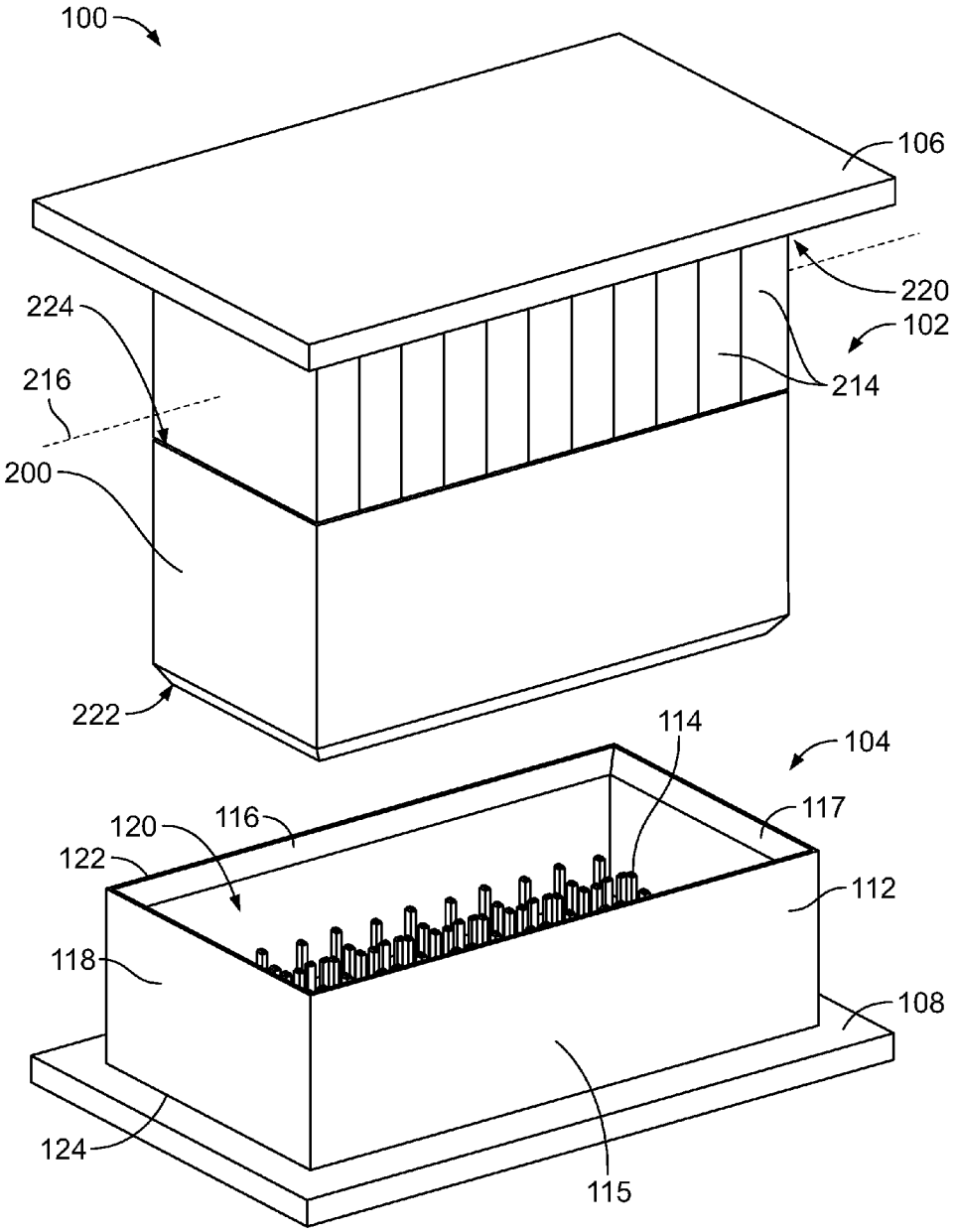
FIG. 1 is a top perspective view of an electrical connector system formed in accordance with an embodiment.

FIG. 1 is a top perspective view of an electrical connector system 100 formed in accordance with an embodiment. The electrical connector system 100 includes a first electrical connector 102 and a second electrical connector 104 that are configured to be directly mated together. The electrical connector system 100 may be disposed on or in an electrical component, such as a server, a computer, a router, or the like. In FIG. 1, the first electrical connector 102 and the second electrical connector 104 are shown un-mated, but poised for mating to one another.

In an exemplary embodiment, the first electrical connector 102 is a receptacle connector, and the second electrical connector 104 is a header connector. The electrical connectors 102, 104 are mating halves of a mezzanine connector. However, the subject matter described herein is not intended to be limited to mezzanine connectors but rather may have application to other types of connectors in alternative embodiments, such as right angle connectors or cable-mounted connectors.

The first electrical connector 102 and the second electrical connector 104 are configured to be mounted to and electrically connected to respective first and second circuit boards 106, 108. The first and second electrical connectors 102, 104 are utilized to provide a signal transmission path to electrically connect the circuit boards 106, 108 to one another at a separable mating interface. In FIG. 1, the first electrical connector 102 is mounted to the first circuit board 106, and the second electrical connector 104 is mounted to the second circuit board 108. In an embodiment, the first and second circuit boards 106, 108 are oriented parallel to one another when the first and second electrical connectors 102, 104 are mated. As such, the electrical connector system defines a mezzanine connector system with the electrical connectors 102, 104 arranged between the parallel circuit boards 106, 108. The signal paths or electrical paths through the electrical connectors pass linearly or axially between the circuit boards 106, 108. Optionally, the connectors 102, 104 may have variable heights to provide a desired distance (or fit) between the parallel circuit boards 106, 108. For example, the receptacle connector 102 may have a variable height (for example, a family of different heights), such as by varying the length of the contacts and the height of the housing to control the positioning of the circuit board 106 relative to the circuit board 108. Alternative relative orientations of the circuit boards 106, 108, such as a perpendicular orientation, are possible in other embodiments. In an alternative embodiment, the first electrical connector 102 and/or the second electrical connector 104 may be terminated to one or more cables rather than being board-mounted.

In the illustrated embodiment, the header connector 104 includes a header housing 112 and a plurality of header contacts 114. The header housing 112 extends between a mating end 122 and a mounting end 124. The header housing 112 includes multiple outer walls that define a chamber 120 therebetween. For example, the header housing 112 may include opposite side walls 115, 116 and opposite end walls 117, 118. Optionally, the header housing 112 defines a rectangular cross-sectional shape because the side walls 115, 116 are longer in a longitudinal direction than the end walls 117, 118 are wide in a lateral direction. However, the header housing 112 may have other walls defining other shapes in other embodiments.

The chamber 120 is open at the mating end 122 of the header housing 112 and is configured to receive a portion of the receptacle connector 102 therein. All or at least some of the walls 115-118 may be beveled at the mating end 122 to provide a lead-in section to guide the receptacle connector 102 into the chamber 120 during mating. In the illustrated embodiment, the header housing 112 has a fixed height between the mating end 122 and the mounting end 124. The header housing 112 may be formed of at least one dielectric material, such as a plastic or one or more other polymers. A base wall 128 (shown in FIG. 2) may be provided at or near the mounting end 124 that closes the bottom of the chamber 120. The mounting end 124 of the header housing 112 faces, and may also engage, a surface of the second circuit board 108.

The header contacts 114 include signal contacts and ground contacts arranged in an array, such as along rows and columns in the chamber 120. Optionally, the ground contacts may be longer than the signal contacts to form a sequenced mating interface for mating with the receptacle connector 102. The contacts 114 are formed of a conductive material, such as copper, a copper alloy, and/or another metal or metal alloy. In the illustrated embodiment, the contacts 114 include flat blades at mating ends thereof that are disposed in the chamber 120. However, the contacts 114 may have other mating interfaces in alternative embodiments, such as spring beams, sockets, pins, or the like. The header contacts 114 also include terminating segments (not shown) that are configured to engage and electrically connect to a corresponding conductor (not shown) of the circuit board 108. The conductors of the circuit board 108 may be electric pads or traces, plated vias, or the like. In various embodiments, the terminating segments of the header contacts 114 are compliant pins, such as eye-of-the-needle pins, which are received in plated vias of the circuit board 108.

The receptacle connector 102 includes a housing 200 that extends between a mating end 222 and a receiving end 224. The housing 200 is provided at a front of the receptacle connector 102 and in thus referred to herein as a front housing 200. As used herein, relative or spatial terms such as "top," "bottom," "front," "rear," "left," and "right" are only used to distinguish the referenced elements and do not necessarily require particular positions or orientations in the electrical connector system 100 or in the surrounding environment of the electrical connector system 100. In an alternative embodiment, the front housing 200 may be a first housing that is coupled a second housing rearward of the front housing 200. For example, the front housing 200 may be stackable with additional housings to adjust the height of the receptacle connector 102. The front housing 200 may be manufactured from a low loss dielectric material, such as a plastic material. The low loss dielectric material has dielectric properties that have relatively little variation with frequency.

The receptacle connector 102 includes a plurality of contact modules 214 stacked adjacent to one another along a stack axis 216. The contact modules 214 are held by the front housing 200. For example, the front housing 200 defines a cavity 218 (shown in FIG. 2) that receives the contact modules 214 to hold the contact modules 214 adjacent to each other along the stack axis 216. The contact modules 214 are loaded into the cavity 218 at an opening at the receiving end 224 of the front housing 200. The contact modules 214 extend from the receiving end 224 of the front housing 200 and define a mounting end 220 of the receptacle connector 102. Therefore, the receptacle connector 102 has a height that extends from the mating end 222 of the front housing 200 to the mounting end 220 defined by the contact modules 214. The mounting end 220 faces, and optionally engages, a surface of the circuit board 106. The receptacle connector 102 includes a plurality of signal contacts 230 and ground contacts 232 (both shown in FIG. 2) that extend through the front housing 200 and the contact modules 214. The signal and ground contacts 230, 232 are provided at or near both the mating end 222 and the mounting end 220 for termination to the header connector 104 and the circuit board 106, respectively. In an embodiment, the receptacle connector 102 includes lossy blocks 202 (shown in FIG. 2) that are mounted to the ground contacts 232 within the contact modules 214. The lossy blocks 202 are composed of a lossy material configured to absorb at least some electrical resonance that propagates along the current path defined by the ground contacts 232 and/or the signal contacts 230 between the mating end 222 and the mounting end 220 of the receptacle connector 102.

Figure 2:
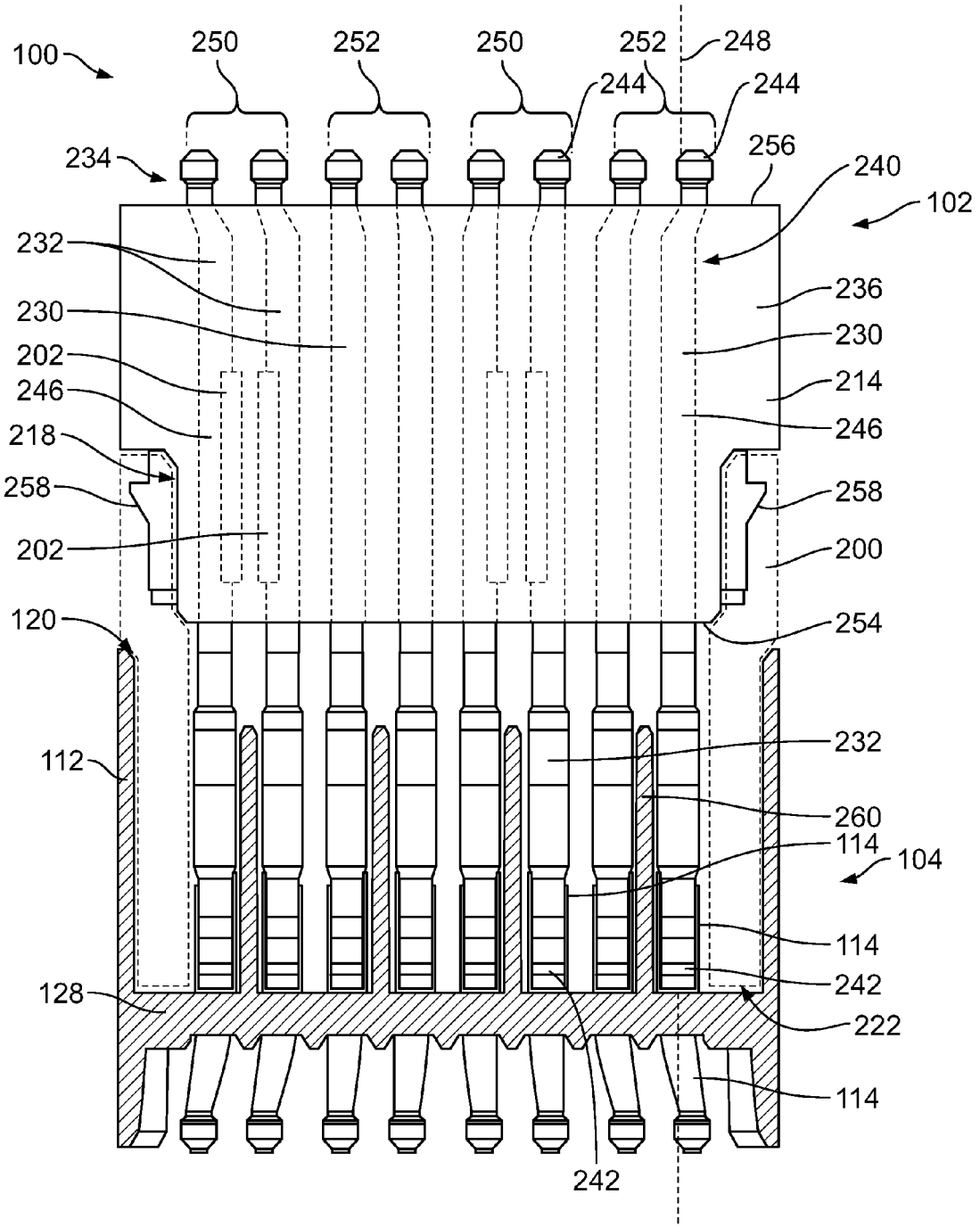
FIG. 2 is a cross-sectional end view of the electrical connector system with a receptacle connector mated to a header connector.

FIG. 2 is a cross-sectional end view of the connector system 100 of FIG. 1 with the receptacle connector 102 mated to the header connector 104. The end view shows one contact module 214 of the receptacle connector 102, and the front housing 200 is shown in phantom. The contact module 214 includes a contact array 234 comprising the signal contacts 230 and the ground contacts 232, a dielectric holder 236 surrounding and engaging the contact array 234 along at least a length of the contact array 234, and the lossy blocks 202 mounted to the ground contacts 232 of the contact array 234. Although only one of the contact modules 214 is shown in FIG. 2, the other contact modules 214 of the receptacle connector 102 may also include respective contact arrays 234, dielectric holders 236, and lossy blocks 202 similar to the illustrated contact module 214.

In an embodiment, the signal contacts 230 and the ground contacts 232 of the contact array 234 are arranged in a column 240. Thus, the contacts 230, 232 in each contact module 214 may align with one another in a corresponding column 240 of contacts. Optionally, the signal contacts 230 and ground contacts 232 may be similar or identical to each other. For example, the signal and ground contacts 230, 232 extend between mating ends 242 and terminating ends 244. The mating ends 242 of the signal contacts 230 and the ground contacts 232 are configured to engage and electrically connect to the corresponding signal and ground contacts of the header contacts 114 of the header connector 104. The mating ends 242 include or define flat blades in the illustrated embodiment, but may have other mating interfaces in other embodiments, such as spring beams, pins, sockets, or the like. The terminating ends 244 are configured to engage and electrically connect to corresponding conductors or conductive elements (not shown) of the circuit board 106 (shown in FIG. 1), such as electric pads or traces, plated vias, or the like. The terminating ends 244 in the illustrated embodiment are solder tails, but the terminating ends 244 may be compliant pins, such as eye-of-the-needle pins, in alternative embodiments. The signal and ground contacts 230, 232 have intermediate segments 246 between the mating and terminating ends 242, 244. The signal and ground contacts 230, 232 extend generally along parallel contact axes 248, although the terminating ends 244 optionally may be jogged, stepped, or otherwise offset from the contact axes 248 to align with the layout or pattern of the conductive elements of the circuit board 106. The signal and ground contacts 230, 232 are composed of an electrically conductive material, such as copper, a copper alloy, and/or another metal or metal alloy. Optionally, the signal and ground contacts 230, 232 of the contact array 234 may be stamped and formed. For example, the signal and ground contacts 230, 232 of the contact array 234 may be connected to each other on a carrier strip that is detached from the signal and ground contacts 230, 232 during the assembly of the receptacle connector 102, such as after the contact array 234 is surrounded and held by the dielectric holder 236 and before the contact module 214 is loaded into the front housing 200 (shown in FIG. 1).

In an embodiment, the signal contacts 230 and the ground contacts 232 of the contact array 234 are arranged in alternating pairs along the length of the column 240. Thus, a pair of ground contacts 232 (referred to herein as a ground pair 250) is disposed between two pairs of signal contacts 230 (referred to herein as signal pairs 252) in the column 240 and/or a signal pair 252 is disposed between two ground pairs 250. The signal pairs 252 may be configured to convey differential signals. The ground pairs 250 provide electrical shielding between adjacent signal pairs 252. In an alternative embodiment, only a single ground contact 232 may be disposed between two signal pairs 252. In another alternative embodiment, the signal contacts 230 may alternate with the ground contacts 232 along the column 240 such that a signal contact 230 is flanked on both sides by ground contacts 232.

The lossy blocks 202 (shown in phantom in FIG. 2) are mounted to the ground contacts 232 of the contact array 234. For example, the lossy blocks 202 are mounted to the intermediate segments 246 of the ground contacts 232 within the dielectric holder 236. Each lossy block 202 is associated with a corresponding ground pair 250 and engages at least one of the ground contacts 232 in the pair 250. In the illustrated embodiment, each lossy block 202 engages only one ground contact 232. For example, two lossy blocks 202 are associated with each ground pair 250, and each ground contact 232 is engaged by only one lossy block 202. The lossy blocks 202 extend a length of the ground contacts 232 within the dielectric holder 236. The lengths of the lossy blocks 202 may be selected based on tuning to provide sufficient absorption of electrical resonance while limiting signal degradation (for example, insertion loss) due to the lossy material of the lossy blocks 202. The lossy blocks 202 are separated from the signal contacts 230 such that the lossy blocks 202 do not engage the signal contacts 230.

The dielectric holder 236 surrounds and engages the signal and ground contacts 230, 232 of the contact array 234 to secure the contacts 230, 232 in place relative to the dielectric holder 236. In an embodiment, the dielectric holder 236 surrounds and engages the intermediate segments 246 of the contacts 230, 232. The dielectric holder 236 also surrounds (for example, encases) the lossy blocks 202 mounted to the ground contacts 232. The dielectric holder 236 has a front end 254 and an opposite rear end 256. The signal and ground contacts 230, 232 protrude from the front end 254 to the respective mating ends 242. The signal and ground contacts 230, 232 protrude from the rear end 256 to the respective terminating ends 244. Thus, the mating ends 242 and the terminating ends 244 are exposed from the dielectric holder 236 for engaging the corresponding header contacts 114, and the terminating ends 244 are exposed from the dielectric holder 236 for engaging the electrical elements of the circuit board 106.

The dielectric holder 236 is composed of a low loss dielectric material, such as a plastic, that has a lower electrical loss characteristic than the lossy material of the lossy blocks 202. For example, the low loss dielectric material of the dielectric holder 236 may have a lower dielectric constant relative to the lossy material of the lossy blocks 202. The low loss dielectric material of the dielectric holder 236 may be the same or different than the low loss dielectric material of the front housing 200. In an embodiment, the dielectric holder 236 is overmolded over the contact array 234 and the lossy blocks 202. Thus, the dielectric holder 236 may be formed in situ over the contact array 234 by flowing the low loss dielectric material in a heated flowable state over the contact array 234 and allowing the low loss dielectric material to cool to a rigid state. In an alternative embodiment, the dielectric holder 236 may be formed by joining two pre-formed shell members together at an interface to entrap the contact array 234 between the shell members.

The lossy material of the lossy blocks 202 provides lossy conductivity and/or magnetic lossiness through a portion of the receptacle connector 102. The lossy material has dielectric properties that vary with frequency. The lossy material has a loss tangent that is greater or higher than respective loss tangents of the low loss dielectric materials of the housing 200 and the dielectric holder 236. The lossy material is able to conduct electrical energy, but with at least some loss. The lossy material is less conductive than the conductive material of the contacts 230, 232. The lossy material may be designed to provide electrical loss in a certain, targeted frequency range. The lossy material may include conductive filler elements, such as particles, dispersed within a dielectric binder material. The dielectric binder material, such as a polymer or epoxy, is used as a binder to hold the conductive filler elements in place. The conductive filler elements impart loss to the lossy material. In some embodiments, the lossy material is formed by mixing a binder with a filler that includes conductive particles. Examples of conductive particles that may be used as a filler to form electrically lossy materials include carbon or graphite formed as fibers, flakes, powders, or other particles. Metal in the form of powder, flakes, fibers, or other conductive particles may also be used as the conductive filler elements to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% or more by volume. The lossy material may be magnetically lossy and/or electrically lossy. For example, the lossy material may be composed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. In some embodiments, the lossy material may simultaneously be an electrically-lossy material and a magnetically-lossy material. Such lossy materials may be formed, for example, by using magnetically-lossy filler particles that are partially conductive or by using a combination of magnetically-lossy and electrically-lossy filler particles.

As used herein, the term "binder" encompasses material that encapsulates the filler or is impregnated with the filler. The binder material may be any material that will set, cure, or can otherwise be used to position the filler material. In some embodiments, the binder may be a thermoplastic material such as those traditionally used in the manufacture of electrical connectors. The thermoplastic material may facilitate the molding of the lossy block 202 into the desired shape and/or location. However, many alternative forms of binder materials may be used. Curable materials, such as epoxies, can serve as a binder. Alternatively, materials such as thermosetting resins or adhesives may be used.

In an embodiment, the lossy blocks 202 may be overmolded over the ground contacts 232. For example, the lossy blocks 202 may be formed in situ over the ground contacts 232 by flowing the lossy material in a heated flowable state over the corresponding ground contacts 232 and allowing the lossy material to cool to a rigid state. The lossy blocks 202 are formed on the ground contacts 232 prior to the contact array 234 being received in the dielectric holder 236. For example, in an embodiment, the contact module 214 is formed via a multi-stage overmolding process in which the lossy blocks 202 are overmolded over the ground contacts 232 in a first molding stage and the dielectric holder 236 is overmolded over the contact array 234 and lossy blocks 202 in a subsequent, second molding stage.

The receptacle connector 102 is assembled by loading the contact modules 214 into the cavity 218 of the front housing 200. The dielectric holder 236 may include latching features 258, such as deflectable latches and/or catches, configured to engage complementary latching features (not shown) of the front housing 200 to secure the contact module 214 in the cavity 218. The mating ends 242 of the signal contacts 230 and ground contacts 232 may be received in corresponding contact channels (not shown) of the front housing 200. When the receptacle connector 102 is mated to the header connector 104, the mating end 222 of the front housing 200 is received in the chamber 120 of the header housing 112. The mating ends 242 of the signal contacts 230 and the ground contacts 232 engage the corresponding signal and ground header contacts 114 to establish electrically conductive signal transmission paths between the receptacle and header connectors 102, 104. The header housing 112 optionally includes divider walls 260 within the chamber 120 that partition the chamber 120. The divider walls 260 may extend between the two signal contacts 230 in each signal pair 252 and between the two ground contacts 232 in each ground pair 250 when the receptacle connector 102 is mated to the header connector 104.

Figure 4:
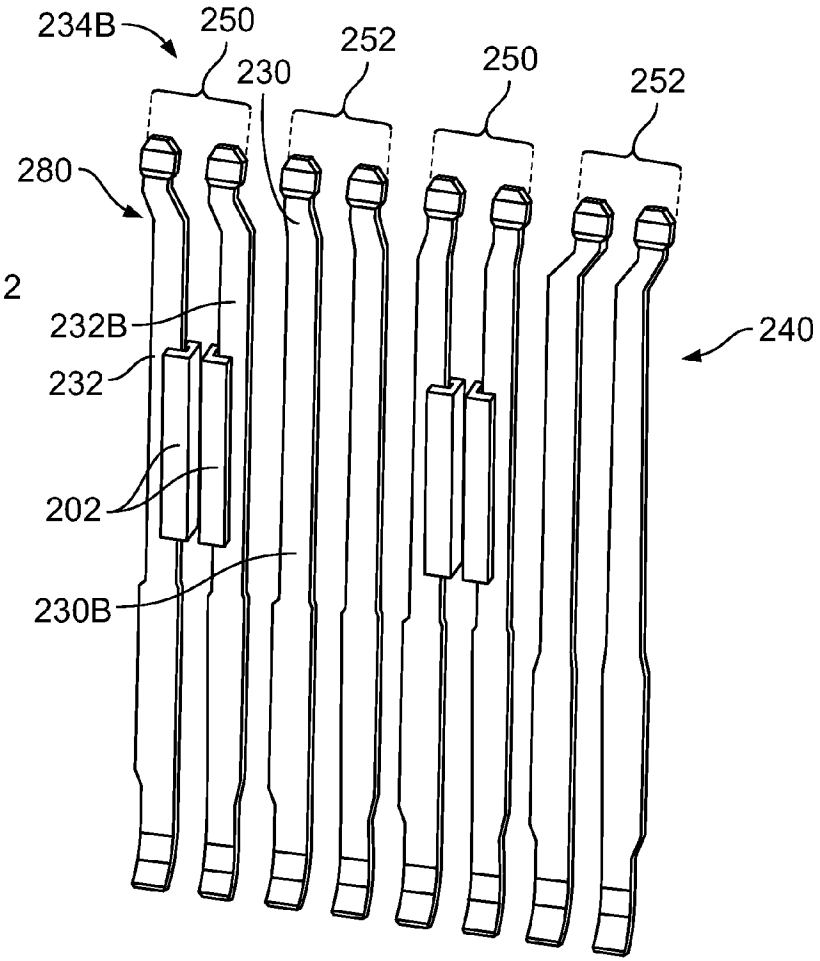
FIG. 4 is a perspective view of a contact array of another contact module adjacent to the contact module that includes the contact array of FIG. 3.
Figure 3:
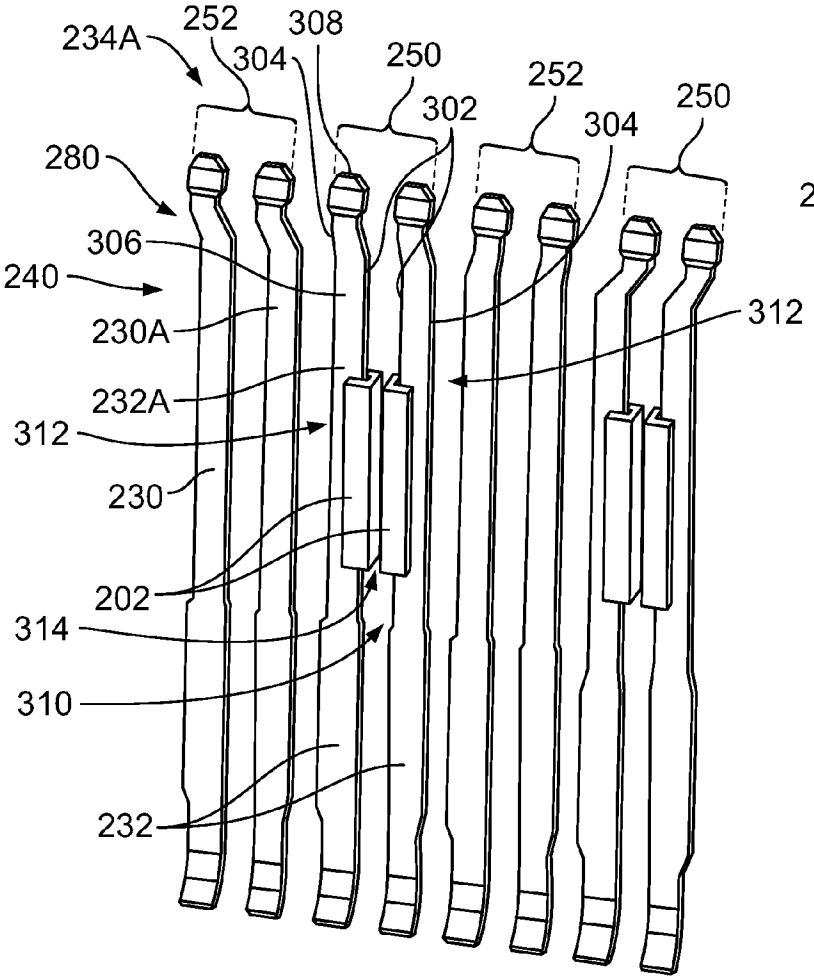
FIG. 3 is a perspective view of a contact array of a contact module of the receptacle assembly according to an embodiment.

FIG. 3 is a perspective view of the contact array 234A of one of the contact modules 214 (shown in FIG. 2) of the receptacle assembly 102 (FIG. 1) according to an embodiment. FIG. 4 is a perspective view of the contact array 234B of another contact module 214 adjacent to the contact module 214 that includes the contact array 234A. In the illustrated embodiment, the contact arrays 234A, 234B each include two signal pairs 252 and two ground pairs 250 that alternate along the length of the respective column 240. In an embodiment, the signal and ground contacts 230, 232 of the contact arrays 234A, 234B are staggered along the lengths of the columns 240. For example, the contact array 234A includes a signal pair 252 at a left end 280 of the column 240 and the contact array 234B includes a ground pair 250 at the left end 280 of the column 240. When the two adjacent contact modules 214 are loaded in the front housing 200 (FIG. 2), the contact array 234A aligns with the contact array 234B to define multiple rows 282 of contacts (shown in FIG. 5). For example, a signal contact 230A of the contact array 234A aligns in a row 282 with a corresponding ground contact 232B of the contact array 234B, and a ground contact 232A of the contact array 234A aligns in a different row 282 with a corresponding signal contact 230B of the contact array 234B. Staggering the signal and ground contacts 230, 232 across adjacent contact modules 214 increases the distance between signal contacts 230 in adjacent contact modules 214 and increases the shielding of the signal pairs 252. For example, at least some signal pairs 252 are flanked by ground contacts 232 in both a lateral direction across the column 240 and a longitudinal direction along the rows 282, as shown in FIG. 5.

The signal contacts 230 and the ground contacts 232 in the contact array 234A have respective inner sides 302, outer sides 304, front sides 306, and back sides 308. The inner sides 302 of the ground contacts 232 in each ground pair 250 face each other and define an inner gap 310 between the ground contacts 232. The outer sides 304 of the ground contacts 232 in each pair 250 face away from each other and define portions of outer gaps 312 between the ground pairs 250 and adjacent signal pairs 252 in the same column 240. The front and back sides 306, 308 extend between the inner and outer sides 302, 304. In an embodiment, the lossy blocks 202 mounted to the ground pairs 250 extend into the inner gaps 310 of the ground pairs 250. For example, the lossy blocks 202 may engage the inner sides 302 of the ground contacts 232. The lossy blocks 202 may extend at least partially around the corresponding ground contacts 232, engaging the front side 306, the back side 308, and the inner side 302 of a corresponding ground contact 232. In an embodiment, the lossy blocks do not engage the outer sides 304 of the ground contacts 232. The lossy blocks 202 associated with a corresponding ground pair 250 optionally do not extend laterally outward beyond the outer sides 304 of the two ground contacts 232 in the pair 250. The lossy blocks 202 extend into the inner gap 310 between the two ground contacts 232, but do not extend into the outer gaps 312. In the illustrated embodiment, two lossy blocks 202 are associated with each ground pair 250. Each of the two lossy blocks 202 engages a different one of the two ground contacts 232 in the pair 250. The two lossy blocks 202 do not engage one another. For example, the lossy blocks 202 are separated from each other by a lossy block gap 314 within the inner gap 310. The lossy block gap 314 may be filled by the low loss dielectric material of the dielectric holder 236 (shown in FIG. 2), such as when the low loss dielectric material is overmolded over the contact array 234. Alternatively, the lossy block gap 314 may be an air gap at least partially filled by air. In an embodiment, the lossy blocks 202 and the signal and ground contacts 230, 232 in the contact array 234B shown in FIG. 4 are identical or at least similar to the lossy blocks 202 and the signal and ground contacts 230, 232 of the contact array 234A shown in FIG. 3.

The signal contacts 230 and the ground contacts 232 each include opposite broad sides and opposite edge sides narrower than the broad sides. In an embodiment, the broad sides are the front and back sides 306, 308, and the edge sides are the inner and outer sides 302, 304. The contacts 230, 232 may be manufactured by stamping and forming, such as from a blank or sheet of stock metal material. The edge sides are defined by the sheared or cut edges during the stamping process. The broad sides are defined by the planar surfaces of the sheet of stock material. In an alternative embodiment, the contacts 230, 232 are oriented such that the broad sides are inner and outer sides 302, 304, and the edge sides are the front and back sides 306, 308.

Figure 5:
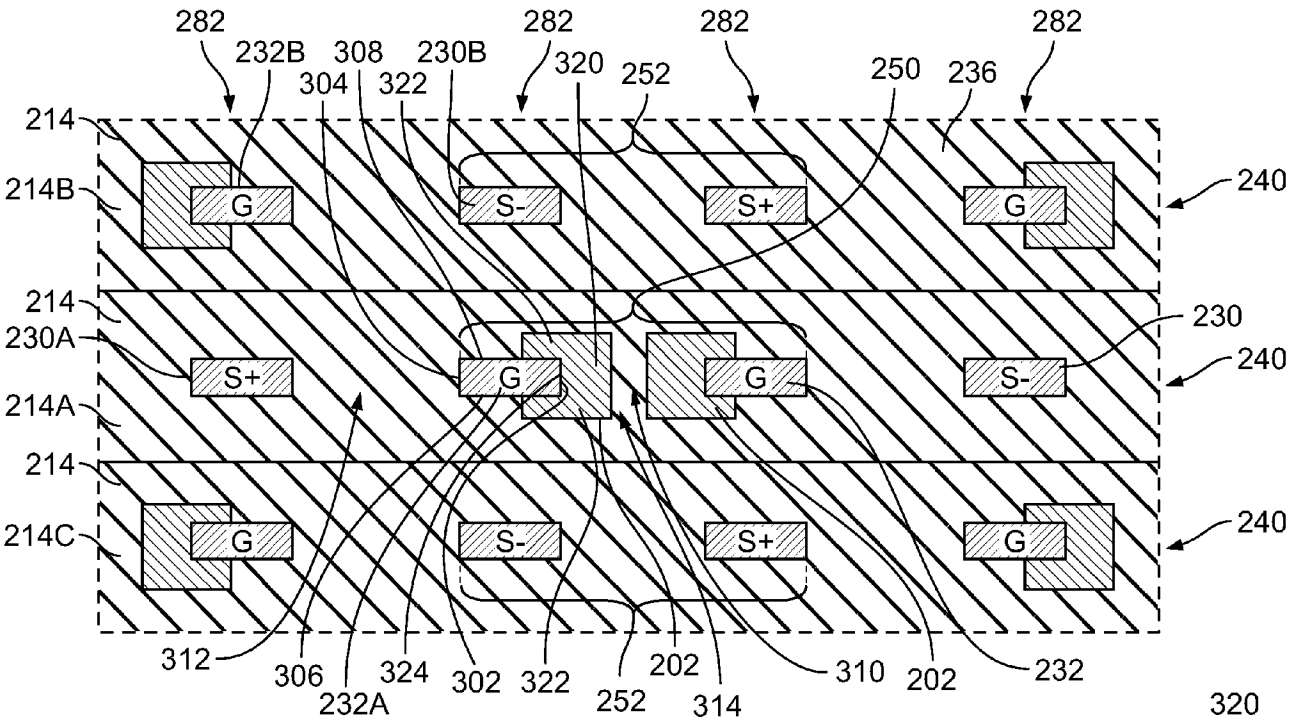
FIG. 5 is a top cross-sectional view of a portion of the receptacle connector showing three contact modules stacked side-by-side.

FIG. 5 is a top cross-sectional view of a portion of the receptacle connector 102 showing three contact modules 214 stacked side-by-side. The signal and ground contacts 230, 232 of each contact module 214 are held by the respective dielectric holder 236 and align in a corresponding lateral column 240. In an embodiment, the signal and ground contacts 230, 232 in different contact modules 214 align in corresponding longitudinal rows 282. The rows 282 may extend perpendicular to the columns 240. As described above with reference to FIGS. 3 and 4, the signal and ground contacts 230, 232 of adjacent contact modules 214 may be staggered such that a signal contact 230A of the contact module 214A aligns in a row 282 with a corresponding ground contact 232B of the contact module 214B, and a ground contact 232A of the contact module 214A aligns in a different row 282 with a corresponding signal contact 230B of the contact module 214B. Due to staggering, a ground pair 250 in the contact module 214A provides shielding between signal contacts 230 in the same contact module 214A across the column 240, and also provides shielding between signal pairs 252 of the contact modules 214B, 214C on both sides of the contact module 214A that align in the same rows 282 as the ground pair 250.

In an embodiment, the lossy blocks 202 include a base 320 and arms 322 (for example, wings or ledges) extending from the base 320. The lossy blocks 202 may include two arms 322 extending generally parallel to each other in a common direction from the base 320. The arms 322 optionally extend an entire length of the lossy block 202. The corresponding ground contact 232, on which the lossy block 202 is mounted, extends between the two arms 322. The arms 322 engage the front and back sides 306, 308, respectively, of the ground contact 232, and a surface 324 of the base 320 between the two arms 322 engages the inner side 302 of the ground contact 232. In an embodiment, the base 320 comprises a majority of the size (for example, mass) of the respective lossy block 202, and the arms 322 comprise less than half of the size of the lossy block 202. Therefore, most of the lossy material of the lossy block 202 is disposed within the inner gap 310 between the ground contacts 232 in the associated ground pair 250. In an alternative embodiment, the base 320 comprises less than half of the size of the lossy block 202, such that a combination of the sizes of the arms 322 is greater than the size of the base 320. In an embodiment, no portion of the lossy block 202 extends beyond the outer side 304 of the ground contact 232 into the outer gap 312 between the ground pair 250 and a signal contact 230 of an adjacent signal pair 252. Arranging the lossy blocks 202 to extend within the inner gaps 310 and not into the outer gaps 312 may reduce detrimental cross-talk between the lossy material of the lossy blocks 202 and the surrounding signal contacts 230, while providing effective absorption of electrical resonance along the ground contacts 232.

In an embodiment, the lossy blocks 202 are formed via overmolding the lossy material over the ground contacts 232. Therefore, the base 320 and the arms 322 are segments or portions of the lossy blocks 202 defined by the shape of the mold and the shape of the ground contact 232. The arms 322 are the portions of the lossy material of the lossy block 202 disposed laterally between the inner side 302 and the outer side 304 of the respective ground contact 232. The base 320 is the portion of the lossy material disposed in the inner gap 310 between the two ground contacts 232 of the associated ground pair 250.

In an alternative embodiment, instead of two lossy blocks 202 that are associated with each ground pair 250 and spaced apart from each other by a lossy block gap 314, a single lossy block may extend between and mount to both ground contacts 232 in the ground pair 250. The single lossy block extends the width of the inner gap 310. The single lossy block absorbs electrical resonance from both ground contacts 232 in the associated pair 250.

Figure 6:
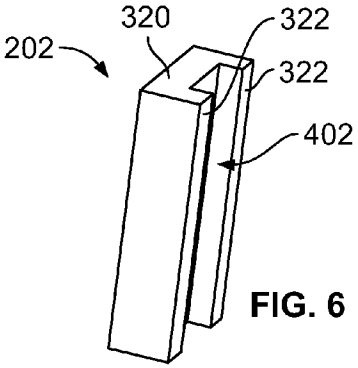
FIG. 6 is a perspective view of a lossy block according to an alternative embodiment.

FIG. 6 is a perspective view of a lossy block 202 according to an alternative embodiment. Although the lossy block 202 in FIG. 6 has an identical or at least similar size and shape as the lossy blocks 202 shown in FIGS. 3-5, the lossy block 202 is pre-formed via a molding process prior to engaging a corresponding ground contact 232 (shown in FIG. 3), instead of being overmolded. For example, the lossy block 202 defines a groove 402 between the arms 322 that extend from the base 320. The groove 402 is sized to receive at least a portion of the ground contact 232 therein. For example, a width of the groove 402 defined between the arms 322 may be sized approximately equal to (or at least slightly smaller than) a thickness of the ground contact 232 between the front and back sides 306, 308 (shown in FIG. 3) to hold the ground contact 232 in the groove 402 via an interference fit. For example, the lossy material of the arms 322 may be forced by the ground contact 232 to at least partially compress and/or deflect outward away from the groove 402 when the ground contact 232 is received in the groove 402. The lossy block 202 may be secured in place relative to the corresponding ground contact 232 via an interference fit, by applying an adhesive or bonding agent, by staking, and/or the like. For example, although not shown, the arms 322 may include crush ribs that extend into the groove 402 to increase the friction between the lossy block 202 and the ground contact 232. Optionally, the lossy block 202 may be lightly held on the ground contact 232 until the dielectric holder 236 (shown in FIG. 2) is overmolded over the lossy block 202 and the ground contact 232, firmly securing the lossy block 202 relative to the ground contact 232.

The above described embodiments provide an electrical connector, such as a mezzanine connector, that provides lossy blocks along portions of the ground contacts. The lossy material absorbs at least some electrical resonance that propagates along the current path defined by the signal contacts and/or the ground contacts to provide lossy conductivity and/or magnetic lossiness. The lossy material provides electrical loss in a certain, targeted frequency range. Electrical performance of the electrical connector is enhanced by the inclusion of the lossy material. For example, at various data rates, including high data rates, return loss is inhibited by the lossy material. For example, the return loss of the small pitch, high speed data of the signal contacts due to the close proximity of signal and ground contacts is reduced by the lossy material. For example, energy from the ground contacts on either side of the signal pair reflected in the space between the ground contacts is absorbed, and thus connector performance and throughput is enhanced.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing; and plural contact modules stacked adjacent to each other along a stack axis and held by the housing, each contact module comprising:

a contact array including signal contacts and ground contacts arranged in a column, the signal contacts and the ground contacts arranged in alternating pairs along a length of the column such that a pair of ground contacts extends between two pairs of signal contacts, the signal and ground contacts extending between respective mating ends configured to engage a mating connector and terminating ends configured to engage a circuit board;

a dielectric holder surrounding and engaging the signal and ground contacts along intermediate segments thereof between the mating and terminating ends to secure the signal and ground contacts in place relative to the dielectric holder, the dielectric holder composed of a low loss material; and lossy blocks mounted to the intermediate segments of the ground contacts within the dielectric holder, each lossy block associated with a corresponding pair of ground contacts and engaging at least one of the ground contacts in the corresponding pair, the lossy blocks composed of a lossy material that has a loss tangent greater than a lost tangent of the low loss material of the dielectric holder.

2. The electrical connector of claim 1, wherein the ground contacts in a corresponding pair each have a respective inner side and an outer side opposite to the inner side, the inner sides facing each other and defining an inner gap between the ground contacts, the lossy blocks extending into the inner gaps of corresponding pairs of ground contacts, the lossy blocks not extending laterally outward beyond the outer sides of the ground contacts.

3. The electrical connector of claim 1, wherein the signal and ground contacts in different contact modules align in multiple rows oriented perpendicular to the columns, the signal and ground contacts in adjacent contact modules being staggered such that a ground contact of one contact module aligns in a first row with a signal contact of an adjacent contact module, and a signal contact of the one contact module aligns in a different row with a ground contact of the adjacent contact module.

4. The electrical connector of claim 1, wherein two lossy blocks are associated with each corresponding pair of ground contacts, each lossy block engaging and at least partially surrounding one of the ground contacts in the corresponding pair of ground contacts, the two lossy blocks separated from each other by a gap.

5. The electrical connector of claim 1, wherein the lossy blocks are overmolded over the intermediate segments of the ground contacts.

6. The electrical connector of claim 1, wherein the dielectric holder is overmolded over the contact array and the lossy blocks.

7. The electrical connector of claim 1, wherein the ground contacts in a corresponding pair each have a respective inner side and an outer side opposite to the inner side, the inner sides facing each other and defining an inner gap between the ground contacts, the lossy blocks engage and extend along the inner sides of the ground contacts in an associated pair of ground contacts and do not engage the outer sides of the ground contacts.

8. The electrical connector of claim 1, wherein the ground contacts in a corresponding pair each have a respective inner side, an outer side opposite to the inner side, and a front side and a back side extending between the inner and outer sides, the inner sides facing each other and defining an inner gap between the ground contacts, the lossy blocks including a base and two arms extending from the base, the arms of each lossy block engaging the front side and the back side, respectively, of a corresponding ground contact, the base engaging the inner side of the corresponding ground contact between the two arms.

9. The electrical connector of claim 8, wherein the base comprises a majority of a size of the respective lossy block such that a majority of the lossy material of the lossy block is disposed within the inner gap between the ground contacts in the corresponding pair.

10. The electrical connector of claim 1, wherein the lossy blocks include a base and two arms extending from the base, the arms of each lossy block extending parallel to each other in a same direction and defining a groove therebetween, each lossy block receiving a corresponding ground contact within the groove to mount the lossy block to the ground contact via an interference fit.

11. An electrical connector comprising:

a housing; and plural contact modules stacked adjacent to each other along a stack axis and held by the housing, each contact module comprising:

a contact array including signal contacts and ground contacts arranged in a column, the signal contacts and the ground contacts arranged in alternating pairs along a length of the column such that a pair of ground contacts extends between two pairs of signal contacts, the signal and ground contacts extending between respective mating ends configured to engage a mating connector and terminating ends configured to engage a circuit board;

a dielectric holder surrounding and engaging the signal and ground contacts along intermediate segments thereof between the mating and terminating ends to secure the signal and ground contacts in place relative to the dielectric holder, the dielectric holder composed of a low loss material; and lossy blocks overmolded over the intermediate segments of the ground contacts within the dielectric holder, each lossy block associated with a corresponding pair of ground contacts and overmolded over at least one of the ground contacts in the corresponding pair, the lossy blocks composed of a lossy material that has a loss tangent greater than a lost tangent of the low loss material of the dielectric holder.

12. The electrical connector of claim 11, wherein the ground contacts in a corresponding pair each have a respective inner side and an outer side opposite to the inner side, the inner sides facing each other and defining an inner gap between the ground contacts, the lossy blocks extending into the inner gaps of corresponding pairs of ground contacts, the lossy blocks not extending laterally outward beyond the outer sides of the ground contacts.

13. The electrical connector of claim 11, wherein the dielectric holder is overmolded over the contact array and the lossy blocks.

14. The electrical connector of claim 11, wherein two lossy blocks are associated with each corresponding pair of ground contacts, each lossy block engaging and at least partially surrounding one of the ground contacts in the corresponding pair of ground contacts, the two lossy blocks separated from each other by a gap.

15. The electrical connector of claim 11, wherein the ground contacts in a corresponding pair each have a respective inner side and an outer side opposite to the inner side, the inner sides facing each other and defining an inner gap between the ground contacts, the lossy blocks engage and extend along the inner sides of the ground contacts in an associated pair of ground contacts and do not engage the outer sides of the ground contacts.

16. The electrical connector of claim 11, wherein the signal and ground contacts in different contact modules align in multiple rows oriented perpendicular to the columns, the signal and ground contacts in adjacent contact modules being staggered such that a ground contact of one contact module aligns in a first row with a signal contact of an adjacent contact module, and a signal contact of the one contact module aligns in a different row with a ground contact of the adjacent contact module.

17. An electrical connector comprising:

a housing; and plural contact modules stacked adjacent to each other along a stack axis and held by the housing, each contact module comprising:

a contact array including signal contacts and ground contacts arranged in a column, the signal and ground contacts extending between respective mating ends configured to engage a mating connector and terminating ends configured to engage a circuit board;

lossy blocks mounted to the ground contacts, each lossy block engaging a different corresponding ground contact, the lossy blocks composed of a lossy material; and a dielectric holder overmolded over the contact array and the lossy blocks to secure the signal contacts, the ground contacts, and the lossy blocks in place relative to the dielectric holder, the mating ends and the terminating ends of the signal contacts and the ground contacts protruding outward from respective front and rear ends of the dielectric holder, the dielectric holder composed of a low loss material that has a loss tangent lower than a loss tangent of the lossy material of the lossy blocks.

18. The electrical connector of claim 17, wherein the signal contacts and the ground contacts are arranged in alternating pairs along a length of the column such that a pair of ground contacts extends between two pairs of signal contacts.

19. The electrical connector of claim 18, wherein the ground contacts in a corresponding pair each have a respective inner side and an outer side opposite to the inner side, the inner sides facing each other and defining an inner gap between the ground contacts, the lossy blocks extending into the inner gaps of corresponding pairs of ground contacts, the lossy blocks not extending laterally outward beyond the outer sides of the ground contacts.

20. The electrical connector of claim 17, wherein the lossy blocks are overmolded over the ground contacts in a first molding stage prior to the dielectric holder being overmolded over the contact array and the lossy blocks in a second molding stage.

* * * * *